US007264520B1

(12) United States Patent
Taylor et al.

(10) Patent No.: US 7,264,520 B1
(45) Date of Patent: Sep. 4, 2007

(54) COOLING SYSTEM FOR AN OUTBOARD MOTOR HAVING BOTH OPEN AND CLOSED LOOP PORTIONS

(75) Inventors: Christopher J. Taylor, Kiel, WI (US); David J. Belter, Oshkosh, WI (US); Klaus Fuoss, Fond du Lac, WI (US); Scott M. Westpfahl, Oshkosh, WI (US); Daniel J. Balogh, Menasha, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/585,613

(22) Filed: Oct. 24, 2006

(51) Int. Cl.
*F01P 3/20* (2006.01)

(52) U.S. Cl. ..... 440/88 HE

(58) Field of Classification Search ..... 440/88 HE, 440/88 D, 89 B

See application file for complete search history.

(56) References Cited

U.S. PATENT DOCUMENTS

| | | | | |
|---|---|---|---|---|
| 4,260,011 | A | 4/1981 | Brown | 165/35 |
| 5,009,622 | A | 4/1991 | Dudney | 440/88 |
| 5,383,803 | A | 1/1995 | Pilgrim | 440/88 |
| 5,921,829 | A | 7/1999 | Iwata | 440/88 |
| 6,513,463 | B2 | 2/2003 | Katayama | 123/41.29 |
| 6,544,086 | B2 | 4/2003 | Tscherne et al. | 440/88 |
| 6,899,580 | B1 * | 5/2005 | Kollmann | 440/88 F |

* cited by examiner

*Primary Examiner*—Stephen Avila
(74) *Attorney, Agent, or Firm*—William D. Lanyi

(57) ABSTRACT

A cooling system for an outboard motor pumps water from a body of water through certain selected portions of the outboard motor and through a heat exchanger which, in turn, comprises a coolant conduit that is directed to conduct the coolant in thermal communication with various portions of the outboard motor. The engine block is cooled by a flow of the coolant and an engine head is cooled by a flow of water from the body of water. Other heat emitting devices are connected in thermal and fluid communication with the water and coolant conduits.

20 Claims, 7 Drawing Sheets

COOLING SYSTEM FOR AN OUTBOARD MOTOR HAVING BOTH OPEN AND CLOSED LOOP PORTIONS

BACKGROUND OF THE INVENTION

1. Field of the Invention

The present invention is generally related to cooling systems for outboard motors and, more particularly, to a cooling system that provides a closed loop portion for a first set of heat emitting components and an open loop portion for a second set of heat emitting components.

2. Description of the Related Art

Many different types of cooling systems are known, to those skilled in the art, for use in conjunction with outboard motors. Some of these systems are open loop systems, in which water is pumped from a body of water, circulated through various cooling passages of the outboard motor, and then returned to the body of water. Other types of cooling systems for outboard motors utilize a closed loop through which a coolant is circulated in thermal communication with one or more heat emitting components of the outboard motor. In a closed cooling loop system, a heat exchanger is used to remove heat from the coolant.

U.S. Pat. No. 4,260,011, which issued to Brown on Apr. 7, 1981, describes a thermostatically controlled liquid cooling apparatus for outboard motors. The system comprises a closed circuit for circulating a liquid such as fresh water through the portions of an outboard motor to be cooled. The circuit includes a thermostatically controlled mixing valve and a heat exchanger. The mixing valve is disposed between the cooling lines of the outboard motor and the heat exchanger and is connected to an outlet line from the outboard motor, the inlet of the heat exchanger, and an inlet line running from the outlet of the heat exchanger to a cooling line of the outboard motor.

U.S. Pat. No. 5,009,622, which issued to Dudney on Apr. 23, 1991, describes cooling systems for marine motors. The system has a coolant path which is external to the motor housing of the motor. The external coolant path is connected across the inlet and outlet of the internal coolant path through which coolant is normally conveyed to cool the hot zones of the motor. A closed circuit is thus formed. The external coolant path includes a heat exchanger arranged to place the coolant in heat exchange relationship with water in which the motor runs.

U.S. Pat. No. 5,383,803, which issued to Pilgrim on Jan. 24, 1995, describes an outboard motor cooling system. The motor is equipped with a closed circuit cooling system having a coolant pump, a heat exchanger, an expansion tank, a series of coolant passages in the motor and some external piping to complete the circuit. In one embodiment of the invention, a conventional outboard motor is modified to include the closed circuit coolant system with the conventional water pump being converted to the coolant pump.

U.S. Pat. No. 5,921,829, which issued to Iwata on Jul. 13, 1999, describes an outboard motor cooling system. The cooling system includes a first cooling system comprising a coolant path through the engine and an oil cooler for cooling the engine and oil of the lubricating system. The cooling system includes a second cooling system comprising a water path from the body of water in which the motor is operating to a heat exchanger and thereon to a discharge back to the body of water. The first cooling system includes two branches, one branch which passes through the heat exchanger and second branch which does not. A control is provided for routing the coolant through the first branch for cooling within the heat exchanger when the coolant is hot, and for routing through the second branch when the coolant is cool, allowing the engine to warm up.

U.S. Pat. No. 6,513,463, which issued to Katayama on Feb. 4, 2003, describes a cooling system for an outboard motor. It includes a first water passage cooling the engine body and a second water passage branching off from the first water passage upstream of the engine body and extending through the engine components. One engine component is generally positioned above the engine body. Two engine components are positioned on different sides of the engine body. The first and second water passages have separate discharge ports. The engine components are made of a metal material. The second water passage is defined by tubular members made of a corrosion-resistant material and their respective tubular members are embedded in the respective bodies of the engine components.

U.S. Pat. No. 6,544,086, which issued to Tscherne et al. on Apr. 8, 2003, describes a four stroke engine with a cooling system. The cooling system includes a closed loop cooling system for cooling at least a portion of the engine. The cooling system also includes an open loop cooling system for cooling at least a portion of the engine. The open loop cooling system uses coolant from an external source to cool the engine.

The patents described above are hereby expressly incorporated by reference in the description of the present invention.

In an outboard motor, certain engine portions and associated components generate heat rapidly upon startup and must be effectively cooled. Other portions of the outboard motor benefit from initially operating at elevated temperatures. Cooling these components immediately after the outboard motor is started may be deleterious for their optimal performance. In addition, cooling all of the components of an outboard motor with a closed cooling system would require a heat exchanger of significant size and weight. Therefore, it would be beneficial if a cooling system for an outboard motor could selectively cool certain preselected components with a closed cooling system and other preselected components with an open cooling system. In order to take full advantage of the closed cooling system, a thermostat controlled bypass can provide additional benefit.

SUMMARY OF THE INVENTION

A cooling system for an outboard motor, in accordance with a preferred embodiment of the present invention, comprises a water pump, first and second water conduits, an engine block, an engine block cooling passage, an engine head, an engine head cooling passage, a heat exchanger, a first coolant conduit, and a circulation pump. The water pump is configured to draw water from a body of water in which the outboard motor is operating and induce that water to flow through the first and second water conduits. The engine block cooling passage has an engine block inlet and an engine block outlet, the engine head cooling passage has an engine head inlet and an engine head outlet, and the first water conduit is connected in fluid communication with the engine head cooling passage. The first coolant conduit is disposed in thermal communication with the second water conduit within the structure of the heat exchanger and with the engine head cooling passage.

In a preferred embodiment of the present invention, it further comprises a thermostat disposed in thermal and fluid communication with the first coolant conduit and with a second coolant conduit. The second coolant conduit is connected in fluid communication between the thermostat and the engine block inlet. The thermostat is disposed in fluid communication between the engine block outlet and the second coolant conduit.

A particularly preferred embodiment of the present invention can further comprise an oil cooler disposed in fluid and in thermal communication with the first coolant conduit. In certain embodiments of the present invention, it further comprises a third water conduit connected in fluid communication with the water pump and in parallel fluid communication with the first and second water conduits. The preferred embodiment of the present invention can further comprise a fuel system module connected in thermal and fluid communication with the third water conduit. It can also comprise a charge air cooler disposed in thermal and fluid communication with the first water conduit. In addition, a preferred embodiment of the present invention further comprises an exhaust conduit connected in exhaust gas conducting communication with the engine. In a particularly preferred embodiment of the present invention, it further comprises an exhaust conduit cooling passage disposed in thermal communication with the exhaust conduit and in fluid communication with the first water conduit.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 1:
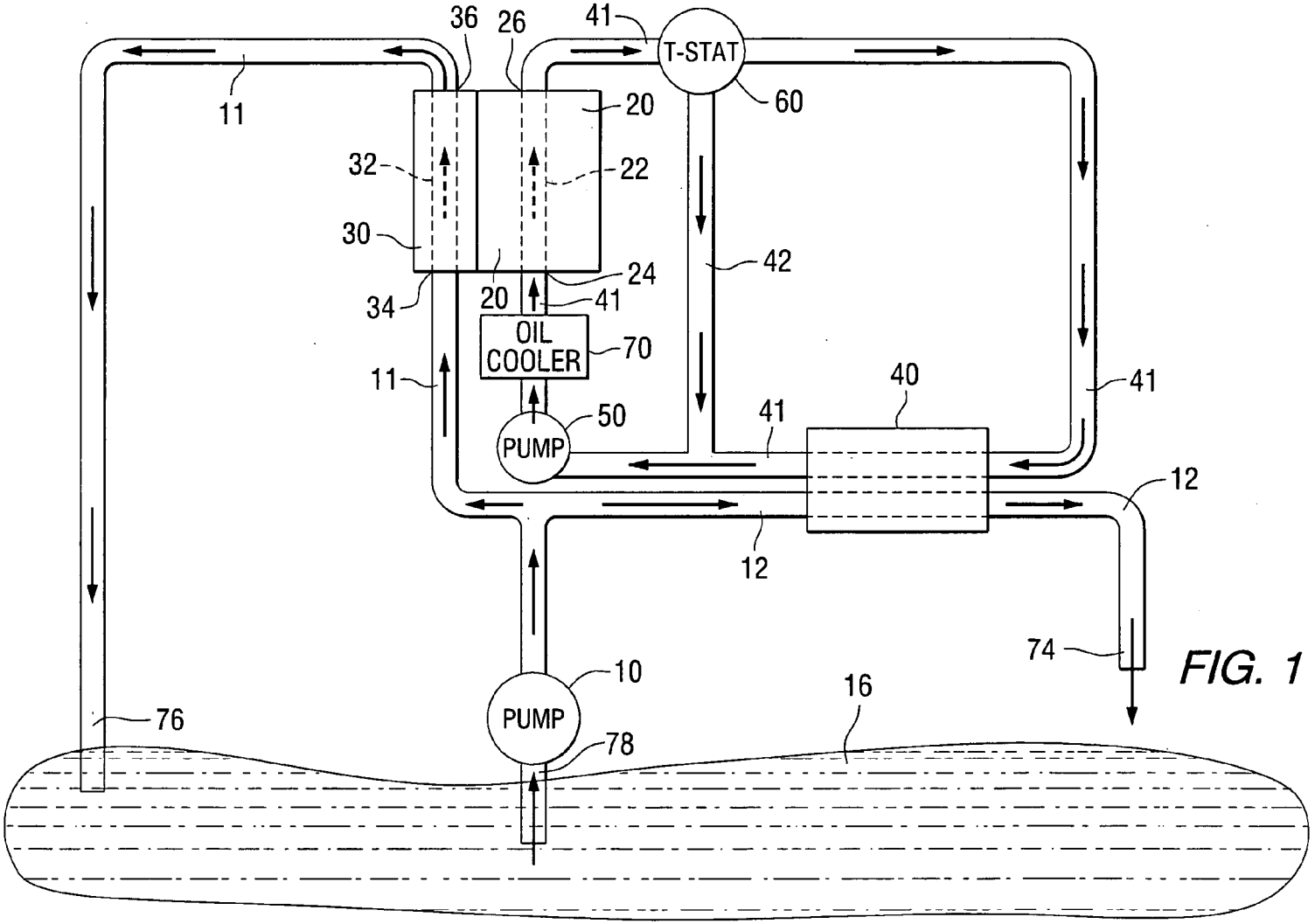
FIG. 1 shows a preferred embodiment of the present invention.

Throughout the description of the preferred embodiment of the present invention, like components will be identified by like reference numerals.

One embodiment of the present invention is illustrated in FIG. 1. The cooling system for an outboard motor comprises a water pump 10, a first water conduit 11 and a second water conduit 12. The water pump 10 is configured to draw water from a body of water 16 in which the outboard motor is operating and induce that water to flow through the first and second water conduits, 11 and 12. A preferred embodiment of the present invention further comprises an engine block 20 having a plurality of cylinders formed therein. The cylinders are not illustrated in FIG. 1, but those skilled in the art of outboard motors are familiar with many different types of configurations in which cylinders are formed within the structure of an engine block 20. An engine block cooling passage 22 is disposed in thermal communication with the plurality of cylinders. The engine block cooling passage 22 has an engine block inlet 24 and an engine block outlet 26. An engine head 30 is attached to the engine block 20. An engine head cooling passage 32 is disposed in thermal communication with a plurality of combustion chambers disposed within the engine head 30. The engine head cooling passage 32 has an engine head inlet 34 and an engine head outlet 36. The first water conduit 11 is connected in fluid communication with the engine head cooling passage 32.

With continued reference to FIG. 1, a preferred embodiment of the present invention further comprises a heat exchanger 40. A first coolant conduit 41 is disposed in thermal communication with the second water conduit 12, within the structure of the heat exchanger 40, and with the engine block cooling passage 22. A circulation pump 50 is disposed in fluid communication with the first coolant conduit 41.

In a preferred embodiment of the present invention, a thermostat 60 is disposed in thermal and fluid communication with the first coolant conduit 41. In a preferred embodiment of the present invention, it further comprises a second coolant conduit 42 that is connected in fluid communication between the thermostat 60 and the engine block inlet 24. The thermostat 60 is connected in fluid communication between the engine block outlet 26 and the second coolant conduit 42 as shown in FIG. 1.

With continued reference to FIG. 1, a preferred embodiment of the present invention further comprises an oil cooler 70 disposed in fluid and thermal communication with the first coolant conduit 41. The thermostat 60 directs a coolant liquid, such as ethylene glycol, from the engine block outlet 26 back to the circulation pump 50, through the second coolant conduit 42, when the temperature of the coolant is below a preselected magnitude. This allows the engine block 20 to warm up to a preselected operating temperature prior to the passage of that liquid coolant through the heat exchanger 40. By allowing the engine block 20 to operate at elevated temperatures, certain disadvantageous conditions can be avoided. For example, when an engine block is cooled below an optimum operating temperature, fuel vapors can condense on the walls of the cylinders and flow into lubricating fluids. As is well known to those skilled in the art, this dilution of engine oil with liquid fuel can result in serious maintenance problems. Therefore, operating the engine block 20 at elevated temperatures can be significantly advantageous. The engine head 30, on the other hand, benefits from immediate cooling with water drawn from the body of water 16.

After flowing through the heat exchanger 40, the water passing through the second water conduit 12 is returned to the body of water 16 through a tell-tale outlet 74. Water flowing through the first water conduit 11, after passing through the engine head cooling passage 32, is returned to the body of water 16 from a portion 76 of the first water conduit 11 which, in certain embodiments of the present invention, causes this water to flow through the propeller of the outboard motor along with the passage of exhaust gas.

However, the precise path of the water from the first water conduit 11 back to the body of water 16 is not limiting to the present invention. The inlet passage 78 through which the pump 10 draws water from the body of water 16 can be an inlet grate provided in the lower portion of a driveshaft housing of an outboard motor or in a surface of its gear case.

With continued reference to FIG. 1, the arrows represent the direction of travel of both the water flowing through the first and second water conduits, 11 and 12, and the coolant flowing through the first and second coolant conduits, 41 and 42.

Figure 2:
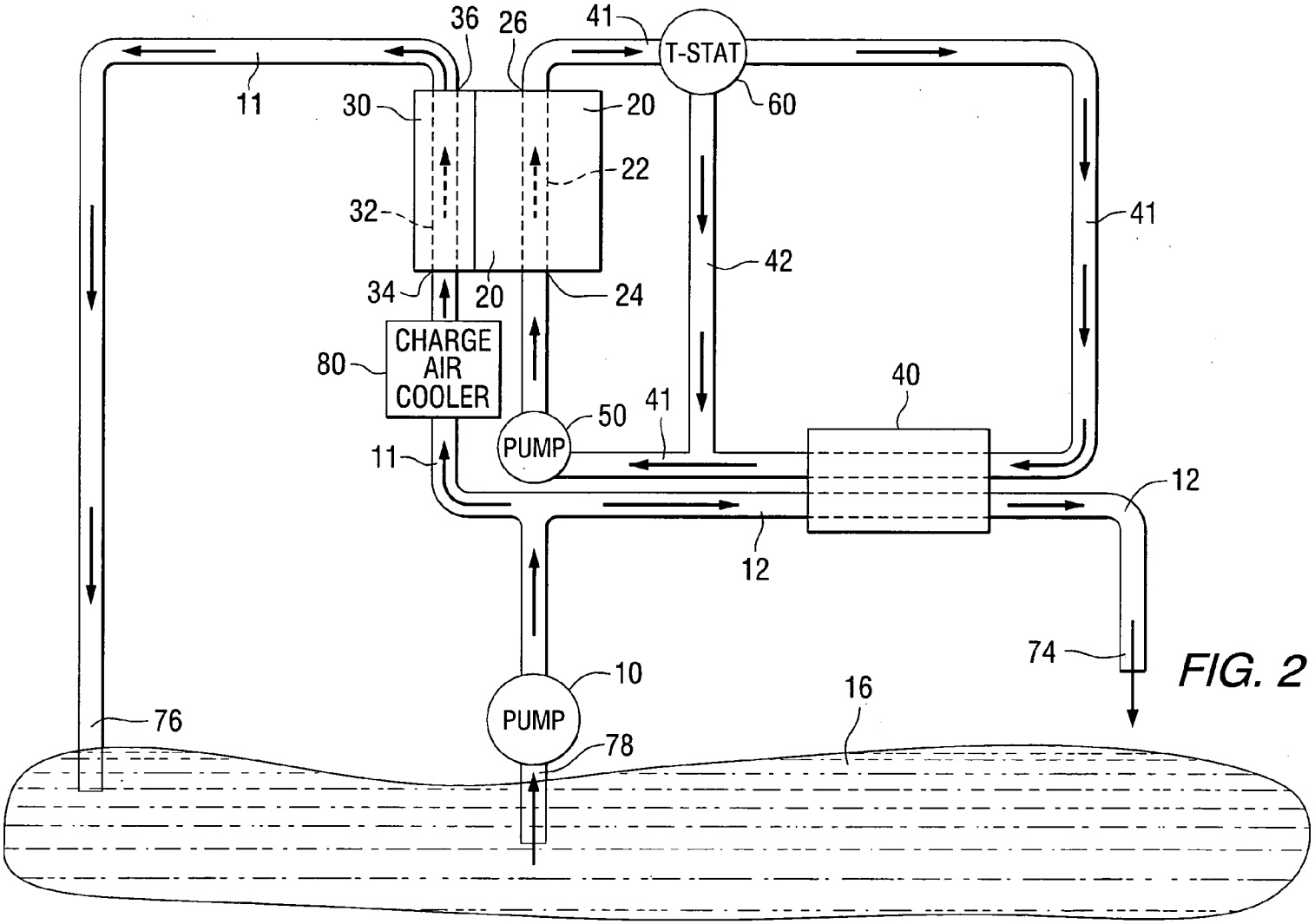
FIG. 2 shows an alternative embodiment of present invention with a charge air cooler connected in thermal and fluid communication with a first water conduit of the cooling system.

FIG. 2 is generally similar to FIG. 1, but with a charge air cooler 80 disposed in thermal and fluid communication with the first water conduit 11. Charge air coolers are, effectively, heat exchangers which reduce the temperature of the charge air being drawn into the air intake manifold of the engine. By reducing the temperature of the charge air, its density is increased and the overall efficiency of the engine's operation is improved. The charge air cooler 80 is connected in thermal communication with the first water conduit 11 so that it can benefit from the reduced temperatures which are made available by the immediate passage of water from the body of water 16 through the charge air cooler 80 subsequent to startup of the engine.

Figure 3:
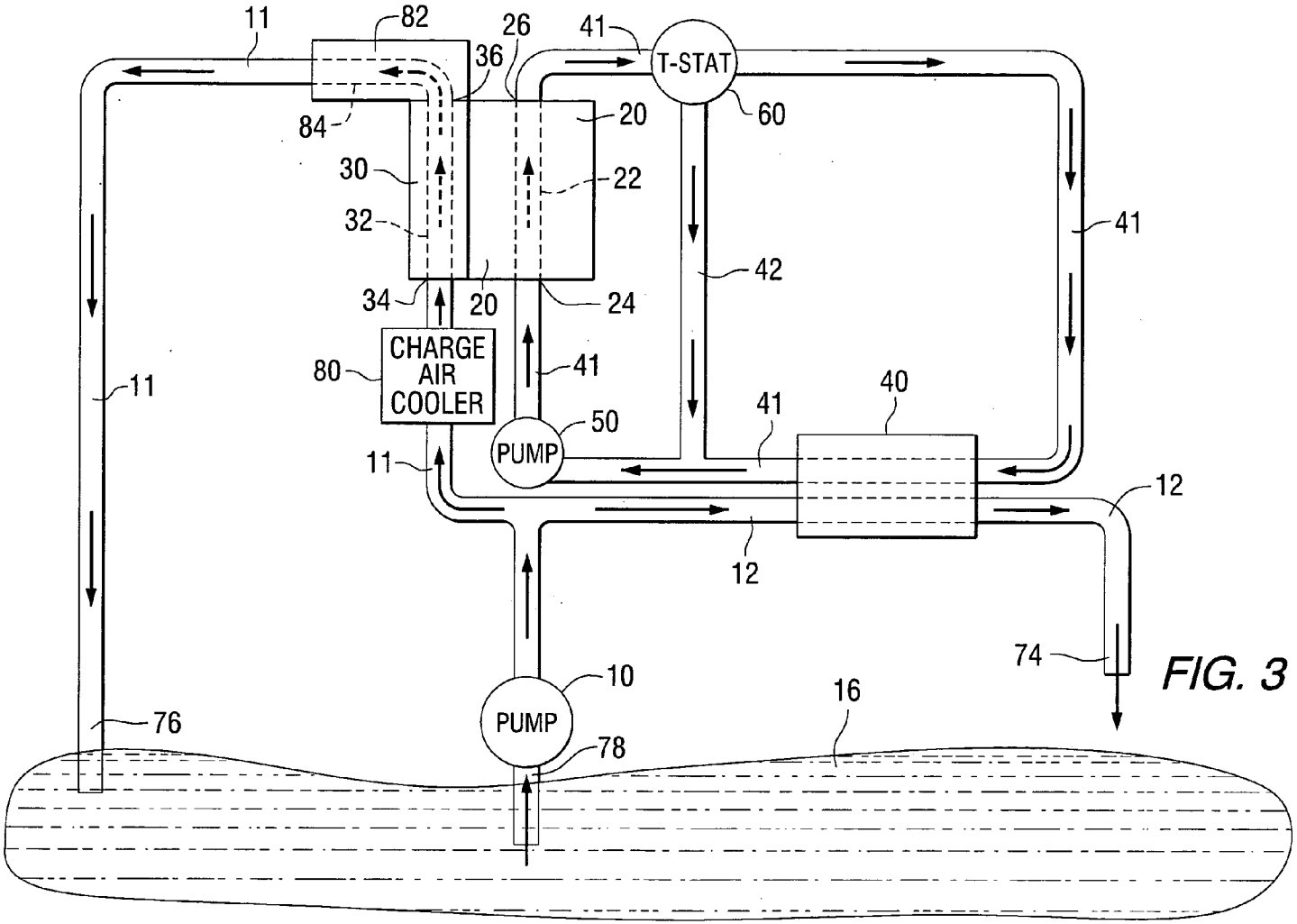
FIG. 3 shows an exhaust manifold connected in thermal communication with the first water conduit of the present invention.

FIG. 3 is generally similar to FIG. 2, but with the exhaust manifold 82 having its exhaust conduit cooling passage 84 disposed in thermal and fluid communication with the first water conduit 11. In certain embodiments of the present invention, a water jacketed exhaust conduit is provided. Water passing through the first water conduit 11 is directed to flow through this water jacket of the exhaust conduit before or after it passes through the engine head cooling passage 32.

Figure 4:
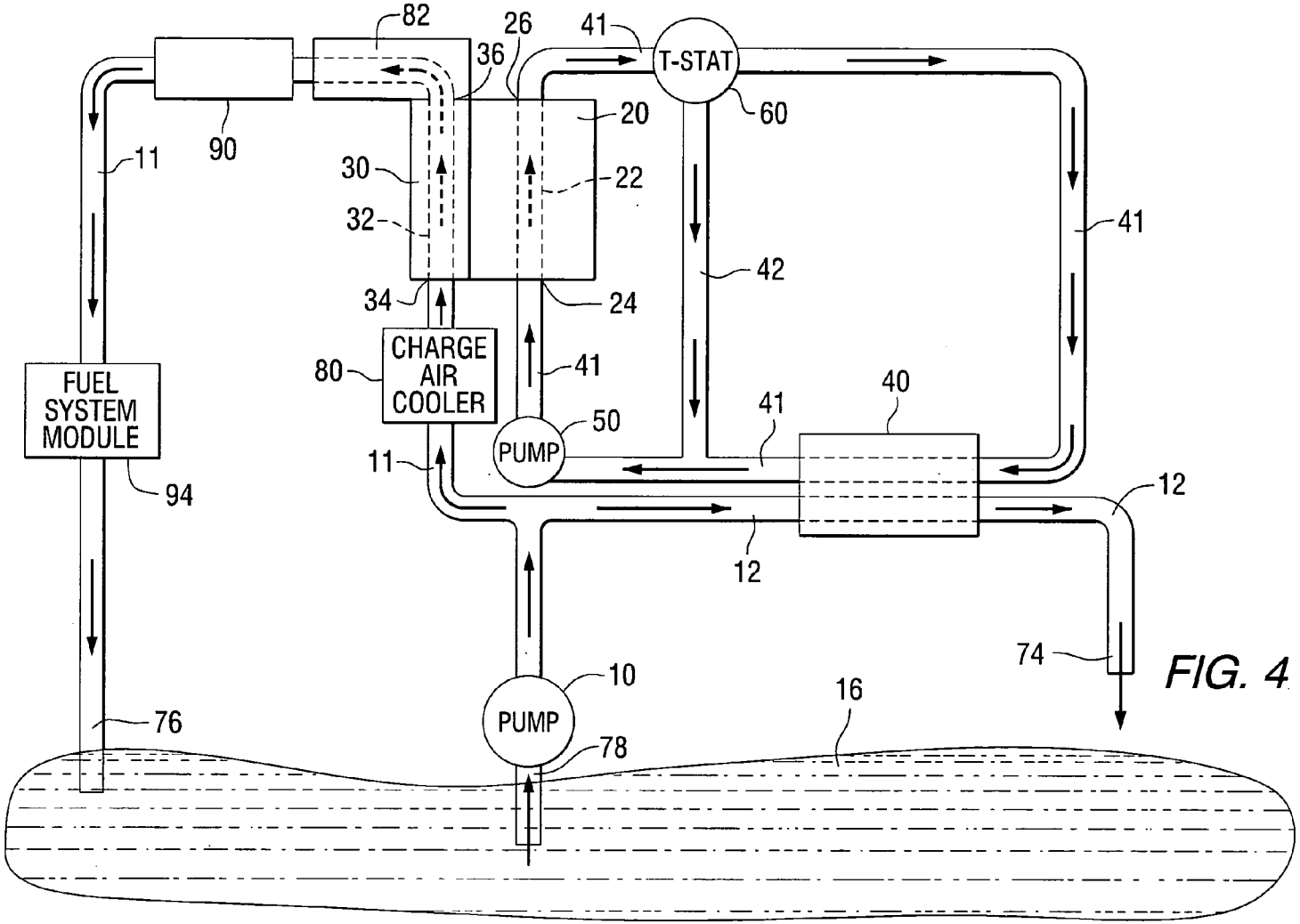
FIG. 4 shows an exhaust conduit connected in fluid communication with the exhaust manifold and also illustrates the location and connection of a charge air cooler and a fuel system module in relation to the first water conduit of the present invention.

FIG. 4 is generally similar to FIG. 3, but shows an embodiment of the present invention in which an exhaust pipe 90, in addition to the exhaust manifold 82, is cooled as a result of the flow of water through the first water conduit 11 in thermal communication with the exhaust pipe. The exhaust pipe 90, in this preferred embodiment of the present invention, is provided with a water jacket through which the water flows on its way back to the body of water 16, after having passed through the cooling passage of the exhaust manifold 82 and the cooling passage of the engine head 30.

With continued reference to FIG. 4, the illustration also shows a fuel system module (FSM) 94 connected in thermal communication with the water flowing through the first water conduit 11. The fuel system module is disposed in thermal communication with the first water conduit in the embodiment shown in FIG. 4, but can be located elsewhere in the system as will be described below.

Figure 5:
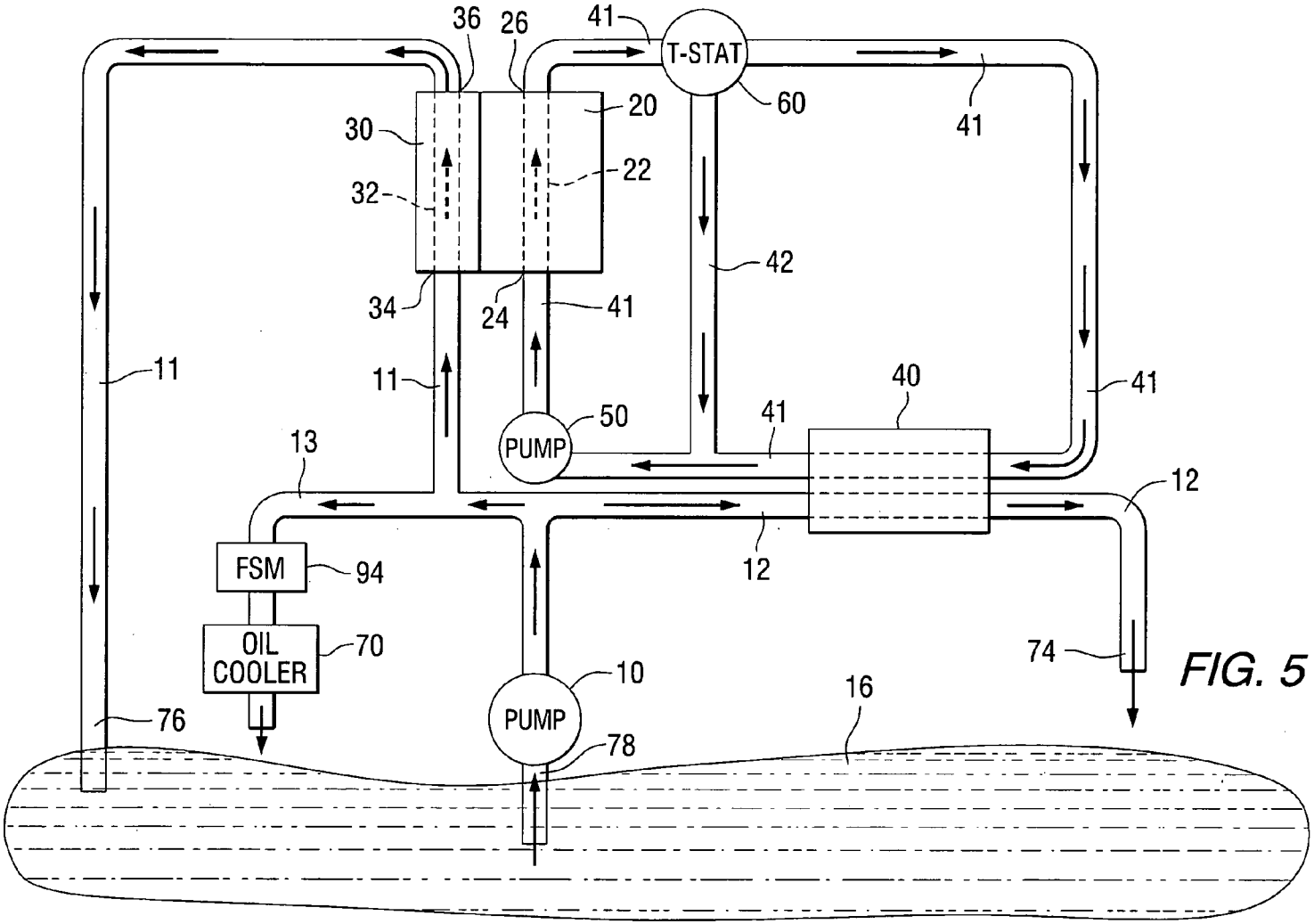
FIG. 5 shows an alternative configuration of the cooling system in which a fuel system module and an oil cooler are connected in thermal and fluid communication with a third water conduit which, in turn, is connected in parallel with the first and second water conduits.

FIG. 5 shows an embodiment of the present invention in which a third water conduit 13 is connected in fluid communication with the water pump 10 and in parallel fluid communication with the first and second water conduits, 11 and 12. A fuel system module (FSM) 94 is shown connected in thermal and fluid communication with the third water conduit 13. This differs from the embodiment shown in FIG. 4 in which the fuel system module 94 was connected in fluid and thermal communication with the first water conduit 11. In addition, the oil cooler 70 is also shown in FIG. 5 connected in thermal and fluid communication with the third water conduit 13.

Figure 6:
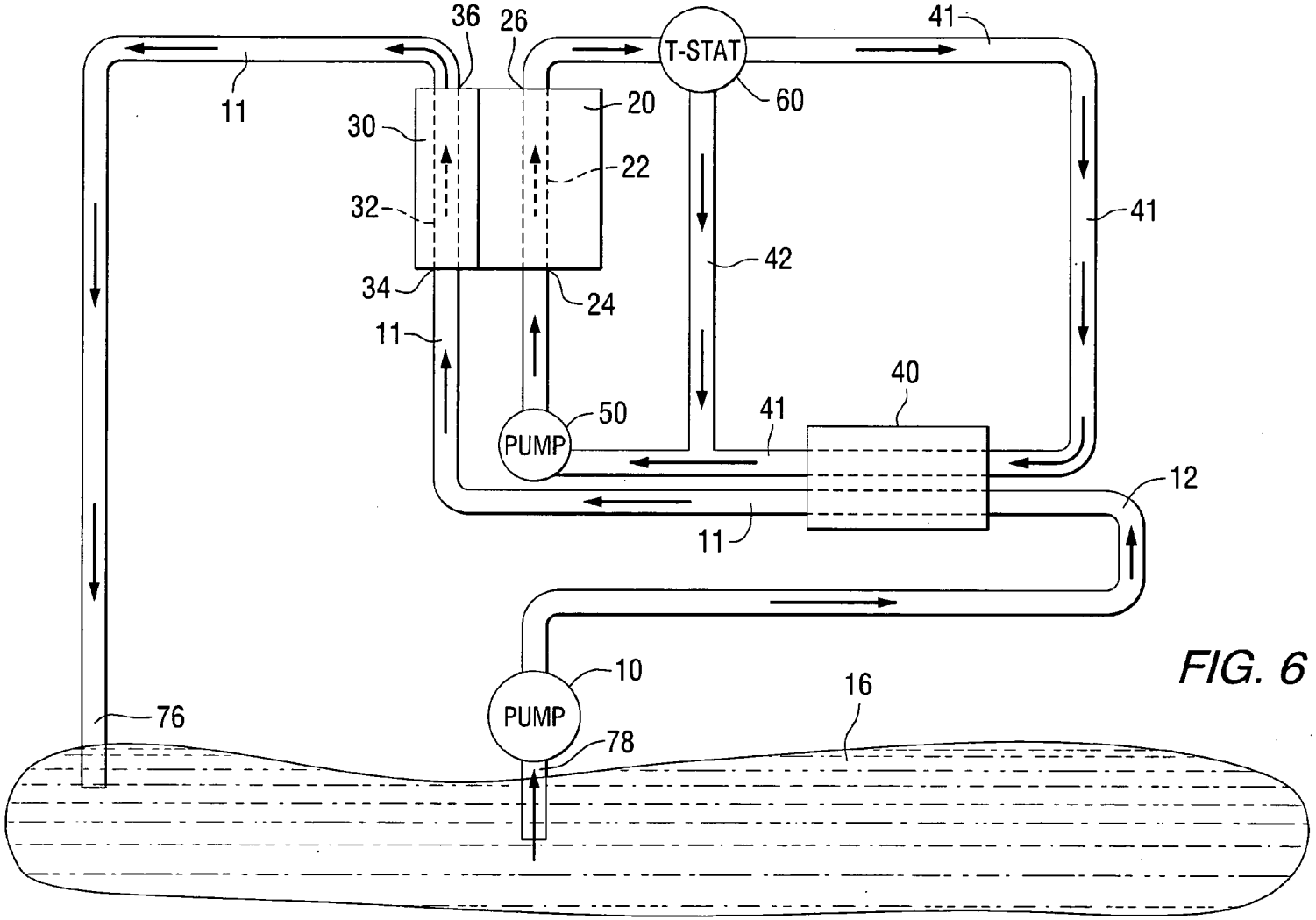
FIG. 6 shows an embodiment of the present invention in which the first and second water conduits are connected in series rather than in parallel.

FIG. 6 is a schematic representation of an alternate embodiment of the present invention. The first and second water conduits, 11 and 12, are disposed in serial fluid communication with each other. The second water conduit 12 conducts water from the pump 10 to the heat exchanger 40 while the first water conduit 111 conducts water from the heat exchanger 40 to the engine head inlet head inlet 34 of the engine head cooling passage 32. The illustrations in FIGS. 1-5 dispose the first and second water conduits, 11 and 12, in parallel association with each other. The other devices, such as the charge air cooler, the oil cooler, and other components, described above in conjunction with FIGS. 1-5 can also be disposed in both fluid and thermal communication with either the first or second water conduits or the first coolant conduit 41 of the closed portion of the cooling system shown in FIG. 6.

Figure 7:
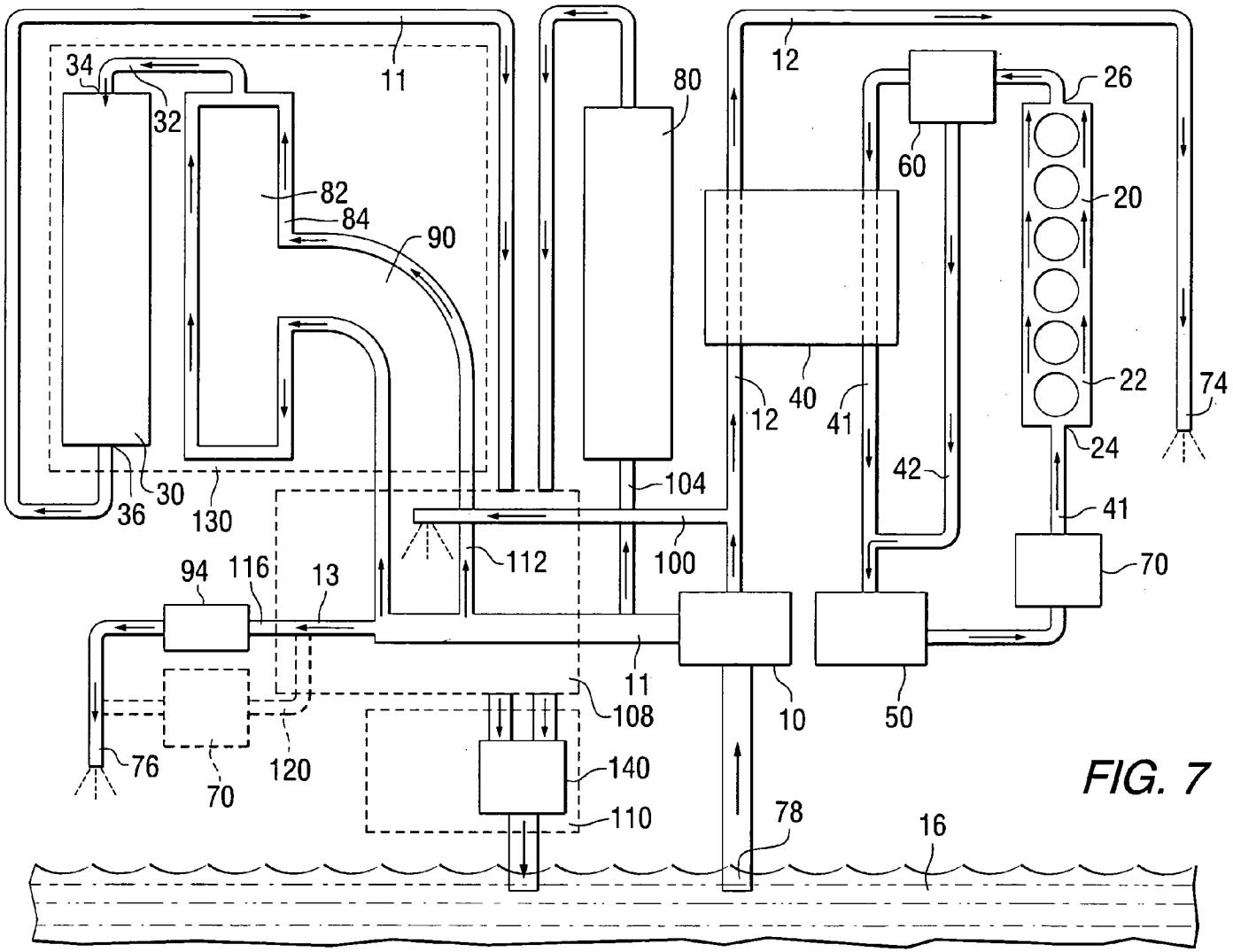
FIG. 7 illustrates a preferred embodiment of the present invention with the components shown in a slightly different configuration and illustrated to more specifically show certain water paths through the cooling system.

FIG. 7 is a schematic representation of an alternate embodiment of the present invention. The illustration in FIG. 7 is generally similar to those in FIGS. 1-6, but the individual components which are cooled by the cooling system are illustrated in slightly greater detail and alternatively positioned in the illustration to more specifically show the relationship of the components to various other components and to more specifically illustrate some of the cooling passages.

With continued reference to FIG. 7, the water is drawn from the body of water 16 by the pump 10 and directed to flow through the first and second water conduits, 11 and 12. In FIG. 7, some of the water from the second water conduit 12 is shown being directed, through conduit 100, to the exhaust pipe 90 to be sprayed into the exhaust gas stream passing from the exhaust manifold 82. From the first water conduit 11, some of the water is directed to flow through a water conduit 104 to a charge air cooler 80. After passing through the charge air cooler 80, the water is caused to flow through the adapter plate 108 of the outboard motor, through the driveshaft housing 110 of the outboard motor, and back to the body of water 16. Some of the water is conducted through the first water conduit 11 into a cooling water passage 112 surrounding a portion of the exhaust pipe. This water allows the temperature of the exhaust pipe and exhaust log to be controlled. A portion of the water flow from the pump 10 is directed through conduit 116 to the fuel system module 94. As can be seen in FIG. 7, an alternative position of the oil cooler 70 is represented by dashed lines to show that this water can also be directed, in parallel, through water conduit 120 to provide cooling water for the oil cooler. After passing through the cooling channel of the exhaust manifold 82, the water is directed through the cylinder head 30 and then through the adapter plate 108 and driveshaft housing 110 before being returned to the body of water 16.

With continued reference to FIG. 7, the closed loop cooling system, comprising the first and second coolant conduits, 41 and 42, is generally similar to that described above in conjunction with FIGS. 1-6. The thermostat 60 is used to bypass the heat exchanger 40 when the temperature of the coolant flowing through the engine block 20 is less than a desired magnitude. The oil cooler 70 is illustrated connected in fluid and thermal communication with the first coolant conduit 41 on the right side of FIG. 7 in addition to its alternative placement in thermal and fluid communication with conduit 120 on the left side of FIG. 7. Dashed line 130 is used to represent the portion of the engine comprising the head 30, exhaust manifold 82, and exhaust conduit 90 above the adapter 108 which is, in turn, located above the driveshaft housing 110 of the outboard motor. It should be understood that FIGS. 1-6 are intended to show a highly simplified representation of the functional positions of the various components of the outboard motor in relation to the flow of cooling water and coolant through those various components and structures. FIG. 7 is intended to show some of the structures in greater detail than FIGS. 1-6 and, more specifically, to illustrate the cooling passages associated with the exhaust conduits. In addition, the dashed line boxes in FIG. 7 are intended to show the relative physical positions of the engine head and exhaust components relative to the adapter plate 108 and the driveshaft housing 110. A pressure responsive poppet valve 140 can be included in the cooling system to respond to the pressure of the water flowing out of the charge air cooler 80 and the engine head 30.

With reference to FIGS. 1-7, it can be seen that a preferred embodiment of the present invention comprises a water pump 10, a first water conduit 11, a second water conduit 12, an engine block 20 having a plurality of cylinders formed therein, an engine block cooling passage 22, an engine head 30, an engine head cooling passage 32, a heat exchanger 40, a first coolant conduit 41, and a circulation pump 50. The water pump is configured to draw water from a body of water 16 in which the outboard motor is operating and induce that water to flow through the first and second water conduits, 11 and 12. In one embodiment of the present invention, the water from the pump 10 flows in parallel through the first and second water conduits, 11 and 12. The engine block cooling passage 22 is disposed in thermal communication with the plurality of cylinders and has an engine block inlet 24 and an engine block outlet 26. The engine head cooling passage 32 is disposed in thermal communication with the plurality of combustion chambers disposed within the engine head. The engine head cooling passage 32 has an engine head inlet 34 and an engine head outlet 36. The first water conduit 11 is connected in fluid communication with the engine head cooling passage 32. The first coolant conduit 41 is disposed in thermal communication with the second water conduit 12 within the heat exchanger 40 and with the engine block cooling passage 22.

In a particularly preferred embodiment of the present invention, a thermostat 60 is disposed in fluid communication with the first coolant conduit 41. In a preferred embodiment of the present invention, it further comprises a second coolant conduit 42 connected in fluid communication between the thermostat 60 and the engine block inlet 24. The thermostat 60 is disposed in fluid communication between the engine block outlet 26 and the second coolant conduit 42. An oil cooler 70 is disposed in fluid and thermal communication with the first coolant conduit 41 in a preferred embodiment of the present invention and a third water conduit 13 is connected in fluid communication with the water pump 10 and in parallel fluid communication with first and second water conduits, 11 and 12. A fuel system module 94 is connected in thermal and fluid communication with the third water conduit 13 in one embodiment of the present invention and a charge air cooler 80 is disposed in thermal and fluid communication with the first water conduit 11. An exhaust conduit, which can comprise an exhaust manifold 82 and an exhaust pipe 90, is connected in exhaust gas conducting communication with the engine. An exhaust conduit cooling passage 84 is disposed in thermal communication with the exhaust gas conduit and in fluid communication with the first water conduit 11.

Although the present invention has been described in particular detail and illustrated to show specific embodiments, it should be understood that alternative embodiments are also within its scope.

We claim:

1. A cooling system of an outboard motor, comprising:

a water pump;

a first water conduit;

a second water conduit, said water pump being configured to draw water from a body of water in which said outboard motor is operating and induce that water to flow through said first and second water conduits;

an engine block having a plurality of cylinders formed therein;

an engine block cooling passage disposed in thermal communication with said plurality of cylinders, said engine block cooling passage having an engine block inlet and an engine block outlet;

an engine head attached to said engine block;

an engine head cooling passage disposed in thermal communication with a plurality of combustion chambers disposed within said engine head, said engine head cooling passage having an engine head inlet and an engine head outlet, said first water conduit being connected in fluid communication with said engine head cooling passage;

a heat exchanger;

a first coolant conduit, said first coolant conduit being disposed in thermal communication with said second water conduit within said heat exchanger and with said engine block cooling passage; and a circulation pump disposed in fluid communication with said first coolant conduit.

2. The cooling system of claim 1, wherein:

said first and second water conduits are connected in parallel with each other.

3. The cooling system of claim 1, further comprising:

a thermostat disposed in thermal and fluid communication with said first coolant conduit.

4. The cooling system of claim 3, further comprising:

a second coolant conduit connected in fluid communication between said thermostat and said engine block inlet, said thermostat being disposed in fluid communication between said engine block outlet and said second coolant conduit.

5. The cooling system of claim 1, further comprising:

an oil cooler disposed in fluid and thermal communication with said first coolant conduit.

6. The cooling system of claim 1, further comprising:

a third water conduit connected in fluid communication with said water pump and in parallel fluid communication with said first and second water conduits.

7. The cooling system of claim 6, further comprising:

a fuel system module connected in thermal and fluid communication with said third water conduit.

8. The cooling system of claim 1, further comprising:

a charge air cooler disposed in thermal and fluid communication with said first water conduit.

9. The cooling system of claim 1, further comprising:

an exhaust conduit connected in exhaust gas conducting communication with said engine.

10. The cooling system of claim 9, further comprising:

an exhaust conduit cooling passage disposed in thermal communication with said exhaust conduit and in fluid communication with said first water conduit.

11. A cooling system of an outboard motor, comprising:

a water pump;

a first water conduit;

a second water conduit, said water pump being configured to draw water from a body of water in which said outboard motor is operating and induce that water to flow through said first and second water conduits;

an engine block having a plurality of cylinders formed therein;

an engine block cooling passage disposed in thermal communication with said plurality of cylinders, said engine block cooling passage having an engine block inlet and an engine block outlet;

an engine head attached to said engine block;

an engine head cooling passage disposed in thermal communication with a plurality of combustion chambers disposed within said engine head, said engine head cooling passage having an engine head inlet and an engine head outlet, said first water conduit being connected in fluid communication with said engine head cooling passage;

a heat exchanger;

a first coolant conduit, said first coolant conduit being disposed in thermal communication with said second water conduit within said heat exchanger and with said engine block cooling passage;

a circulation pump disposed in fluid communication with said first coolant conduit;

a thermostat disposed in thermal and fluid communication with said first coolant conduit;

an exhaust conduit connected in exhaust gas conducting communication with said engine; and an exhaust conduit cooling passage disposed in thermal communication with said exhaust conduit and in fluid communication with said first water conduit.

12. The cooling system of claim 11, wherein:

said first and second water conduits are connected in parallel with each other.

13. The cooling system of claim 11, further comprising:

a second coolant conduit connected in fluid communication between said thermostat and said engine block inlet, said thermostat being disposed in fluid communication between said engine block outlet and said second coolant conduit.

14. The cooling system of claim 11, further comprising:

an oil cooler disposed in fluid and thermal communication with said first coolant conduit.

15. The cooling system of claim 11, further comprising:

a third water conduit connected in fluid communication with said water pump and in parallel fluid communication with said first water conduit; and a fuel system module connected in thermal and fluid communication with said third water conduit.

16. The cooling system of claim 11, further comprising:

a charge air cooler disposed in thermal and fluid communication with said first water conduit.

17. A cooling system of an outboard motor, comprising:

a water pump;

a first water conduit;

a second water conduit, said water pump being configured to draw water from a body of water in which said outboard motor is operating and induce that water to flow through said first and second water conduits;

an engine block having a plurality of cylinders formed therein;

an engine block cooling passage disposed in thermal communication with said plurality of cylinders, said engine block cooling passage having an engine block inlet and an engine block outlet;

an engine head attached to said engine block;

an engine head cooling passage disposed in thermal communication with a plurality of combustion chambers disposed within said engine head, said engine head cooling passage having an engine head inlet and an engine head outlet, said first water conduit being connected in fluid communication with said engine head cooling passage;

a heat exchanger;

a first coolant conduit, said first coolant conduit being disposed in thermal communication with said second water conduit within said heat exchanger and with said engine block cooling passage;

a circulation pump disposed in fluid communication with said first coolant conduit;

a thermostat disposed in thermal and fluid communication with said first coolant conduit;

an exhaust conduit connected in exhaust gas conducting communication with said engine;

an exhaust conduit cooling passage disposed in thermal communication with said exhaust conduit and in fluid communication with said first water conduit;

a second coolant conduit connected in fluid communication between said thermostat and said engine block inlet, said thermostat being disposed in fluid communication between said engine block outlet and said second coolant conduit.

18. The cooling system of claim 17, wherein:

said first and second water conduits are connected in parallel with each other.

19. The cooling system of claim 18, further comprising:

an oil cooler disposed in fluid and thermal communication with said first coolant conduit.

20. The cooling system of claim 19, further comprising:

a third water conduit connected in fluid communication with said water pump and in parallel fluid communication with said first and second water conduits;

a fuel system module connected in thermal and fluid communication with said third water conduit; and a charge air cooler disposed in thermal and fluid communication with said first water conduit.

* * * * *